United States Patent [19]

Gargiulo

[11] 4,193,648

[45] Mar. 18, 1980

[54] MUSIC-BOX CASING

[76] Inventor: Antonio Gargiulo, Sorrento (Napoli), Italy

[21] Appl. No.: 898,881

[22] Filed: Apr. 21, 1978

[30] Foreign Application Priority Data

Apr. 22, 1977 [IT] Italy ..... 22730 A/77

[51] Int. Cl.[2] ..... A47B 81/06; G10F 1/06

[52] U.S. Cl. ..... 312/9; 312/111; 312/204; 108/152; 84/94 C

[58] Field of Search ..... 312/9, 107, 111, 209, 312/263, 264, 348, 245, 208, 224, 204; 220/DIG. 25; 108/152; 84/94 R, 94 C; 5/109

[56] References Cited

U.S. PATENT DOCUMENTS

| | | | |
|---|---|---|---|
| 1,121,841 | 12/1914 | Irwin | 312/204 |
| 1,654,225 | 12/1927 | Tanner | 220/DIG. 25 |
| 2,663,861 | 12/1953 | Heath | 84/94 C |
| 2,751,710 | 6/1956 | Pace | 84/94 C |
| 2,980,478 | 4/1961 | Woehrle | 312/111 |
| 3,122,959 | 3/1964 | Barr | 84/94 C |
| 3,187,926 | 6/1965 | Zimmet | 312/209 |
| 3,261,033 | 7/1966 | Martin | 5/109 |
| 3,496,889 | 2/1970 | Protzmann et al. | 108/152 |
| 3,669,035 | 6/1972 | Grossman | 108/152 |

FOREIGN PATENT DOCUMENTS

| | | | |
|---|---|---|---|
| 345230 | 4/1960 | Switzerland | 84/94 |

*Primary Examiner*—Victor N. Sakran

*Attorney, Agent, or Firm*—Cushman, Darby & Cushman

[57] ABSTRACT

A music box casing structure is disclosed, the configuration of which permits ease and convenience of assembly, that result being achieved by the proper combination of abutments and undercuts formed on the sidewalls and lid of the structure. The advantage are an easy and convenient assemblage, the possibility of moulding the component parts with a plastics material and the opportunity afforded to the user himself to replace a certain tune-producing clockwork with any other at leisure.

4 Claims, 4 Drawing Figures

MUSIC-BOX CASING

This invention relates to a music box casing and, more particularly, a casing construction for a music box which permits that the tune-producing mechanism may be quickly and conveniently assembled and disassembled.

Music box casings are generally known and widespread, which are usually constituted by a container of wood or another stiff material, usually fitted with ornamental patterns and having a lid which, when being opened, and through the agency of a specially provided pushbutton, sets into action the tune-producing mechanism proper, the clockwork of which can be wound up and rewound by means of a special key.

Such casings are usually intended to fulfil other requirements, such as to be used as a cigarette-case for table use, a jewel-box and others.

A shortcoming which is complained of long since, and for which no satisfactory redress has been found heretofore is that the tune produced by the tune-producing mechanism proper (light-music tune of simple melodic line in general), remains unvaried in time and is such as to become tedious in the long run.

In the second place, if the tune-producing mechanism is jammed or is out of order, repairs are virtually impossible since it is commonly necessary to dismember the entire casing with the inherent danger of jeopardizing the ornamental patterns.

Another drawback is that the tune produced by the mechanism cannot easily be identified without actuating such mechanism.

On considering more closely the manufacture of such casings, it is still now at an artisan craft level which is little in agreement with a modern industrial structure, especially if the bearing the workmanship has today on no matter what industrial operation.

The principal object of the present invention is to provide a structure for a music-box-casing which is simple and permits the tune-producing mechanism to be conveniently and quickly replaced consistent with the requirements of industrial production, it being also made possible to identify immediately the tune produced by the tune-producing mechanism.

This object is achieved by having the casing according to the present invention provided with and L-shaped base, the rear wall of which, intended to adhere the adjoining internal surface of the casing, has a positioning and inserting guideway on a specially provided mounting plate or stirrup fastened to said adjoining inner surface of the casing, whereas, against the front wall of said base the tune-producing mechanism is removably affixed, and a lid adapted to make up with said base a parallelepipedal box, said lid having formed therethrough the holes for allowing the passage to the key for winding up the tune-producing mechanism and the pushbutton for starting same, the union between the base and the lide being effected by means of abutments and undercuts.

The features and particular aspects of this invention will become more clearly apparent from the ensuing detailed description of an embodiment thereof, aided by the accompanying drawings, wherein.

Figure 1:
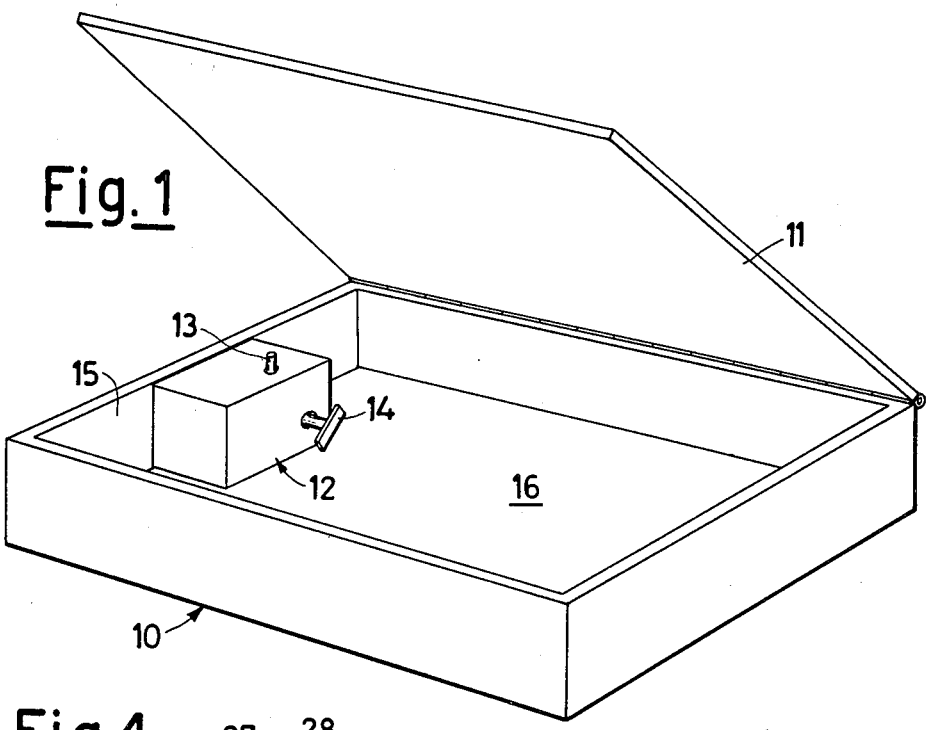
FIG. 1 is a general perspective view of a box having applied thereto the music box casing of this invention.

Having now reference, at the outset, to FIG. 1, a music box is shown, which comprises a lid 11 and a music box casing 12, from which the actuating pushbutton, 13 and the winding key 14 extend. The drawing clearly shows that the starter pushbutton 13 is actuated whenever the lid 11 is lifted. In its turn, as will be appreciated later, the winding key serves also for positioning the tune-producing mechanism proper correctly.

Figure 4:
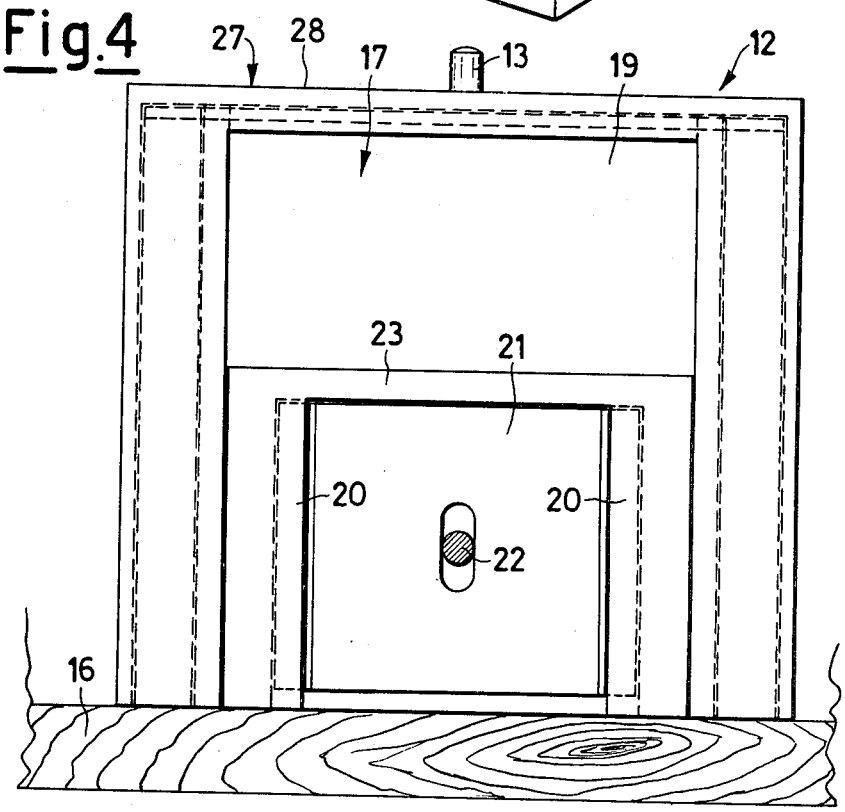
FIGS. 3 and 4 are cross-sectional views, taken along the line III—III of FIG. 2 and the line IV—IV of FIG. 3, respectively.
Figure 2:
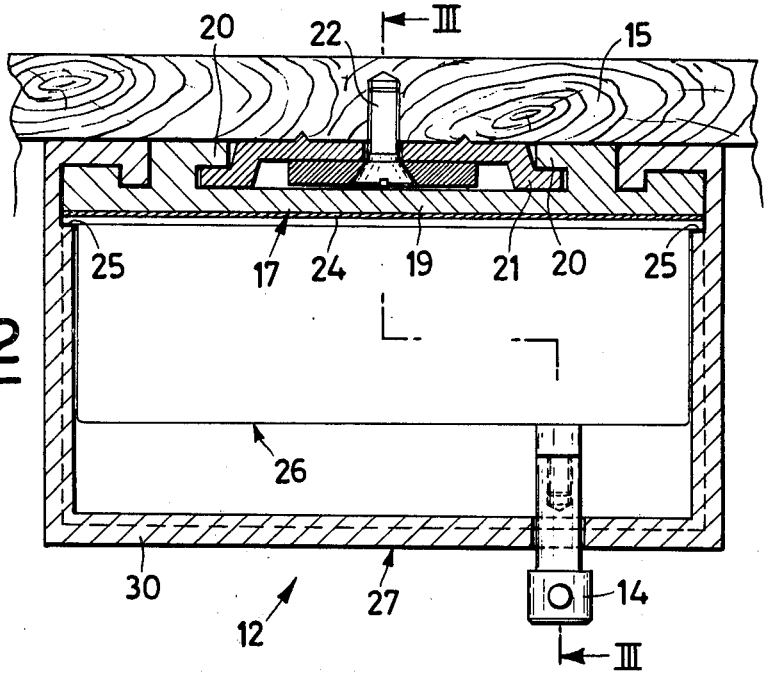
FIG. 2 is a cross-sectional view, from top, taken along the line II—II of FIG. 3.
Figure 3:
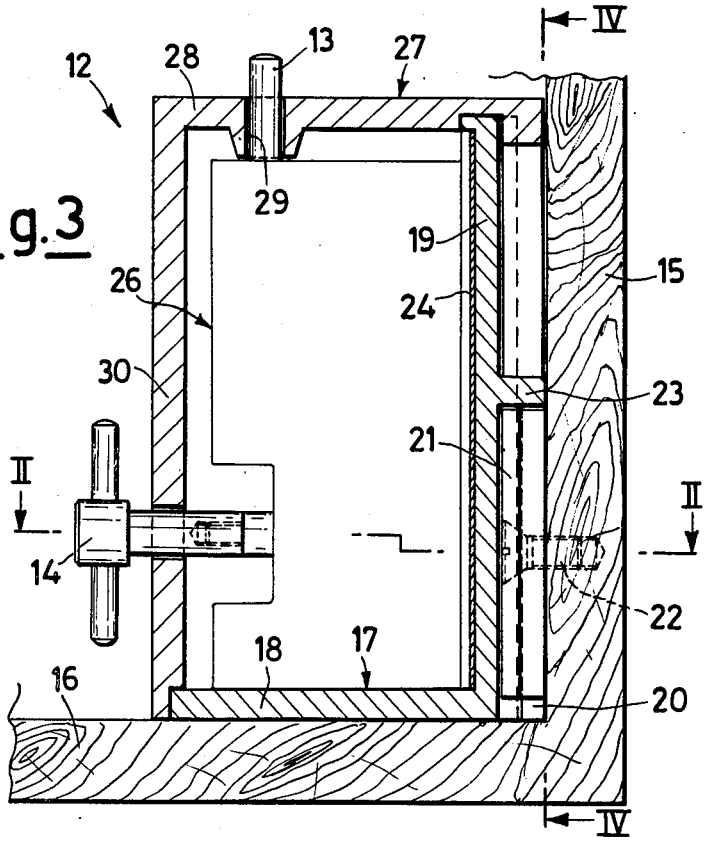

Having now more particular reference to FIGS. 2, 3 and 4, the numeral 15 denotes the wall of the box 10 to which is applied the music box casing 12, whereas the numeral 16 identifies the bottom wall of the box 10.

The music box casing 12 comprises a baseplate 17, shaped in cross-section in the form of a letter "L" and composed by a horizontal web 18 and a vertical web 19. The latter comprises a portion, indicated by flanges or webs 20, intended to engage in a slidable manner with a mounting plate or stirrup 21, the latter being fastened by a screw 22 to the adjoining wall 15 of the box 10. More particularly, the stirrup piece 21 has two side webs or flanges which are spaced from the wall 15 and are adapted to match corresponding grooves or guideways as defined by webs 20.

A cross-rib 23 acts an an abutment and ledger for the stirrup piece 21.

Against the inner surface of the vertical sidewall 19 rests and is then kept in position the tune-producing mechanism proper 26 (shown in phantom only because it is quite conventional), as held by the undercut 25. Between the tune-producing mechanism 26 and the internal face of the sidewall 19 is inserted, during assembly, the label 24 which identifies the tune to be played by the appropriate mechanism. The casing 12 further comprises a lid 27, which is so shaped as to mate the baseplate 17 to make up the parallelepipedal boxlike casing.

The lid 27, more particularly, has a top wall 28, through which a hole 29 is formed, to allow passage for the starter button 13 for the tune-producing mechanism, and a vertical wall 30, parallel to and confronting the vertical side 19 of the baseplate 17, through which a hole is formed for the winding key of the clockwork 14, the key having also the task of keeping united together the several component parts, such as the tune-producing mechanism, the label, the lid, the baseplate and the starter pushbutton.

FIGS. 2 and 3 show also clearly the details of mating of the baseplate 17 with the lid 27, a mating which is achieved by means of abutments and undercuts which not only ensure a guided and quick assemblage but also provide a tight seal against dust and foreign matter which could damage the clockwork. In addition, the absence of detrimental vibrations is fully prevented.

When assembling the music box casing according to this invention, the first step is to position the reference stirrup piece 21, that which takes place by means of the screw 22 and by exploiting the circumstance that the specially provided hole through the stirrup 21 is in the form of a slot so as to provide the positional adjustability for 21. Then, the music box casing is assembled, by the following steps:

(a) Insertion of the starter pusher 13 in its position.
(b) Positioning the clockwork on the baseplate 17.
(c) mating the baseplate with the lid by slipping into engagement.

(d) Insertion and screwing-in the winding up key through the special lid hole, and (e) Slipping the music box casing onto the stirrup piece 21.

Obviously, prior to positioning the clockwork onto the baseplate 17, provision will be made to place the tune display label at its proper place.

It is important to note that the two component parts of the music box casing 12 are made of a stiff plastics material, preferably a transparent one, so as to permit not only to obtain them as moulded pieces but also to permit internal vision, the clockwork becoming thus fully visible.

If the music box casing of this invention is compared with the conventional articles of that kind, it will be seen at once that for these latter the time required for applying the clockwork and closing the clockwork compartment are much longer, this fact having a detrimental bearing on the final cost of the article ready for sale. In addition, the box does no longer necessitate that holes for the winding key and start-stop buttom be formed therethrough.

Additional advantages are the following:

-the useful volume of the box is greater

-the box can be sold and used with and without musical clockwork leaving possibly with the user the choice and the application in position of the tune-producing unit.

-replacement and repair of the musical clockwork are convenient and leave the outer casing fully inaffected -a number of musical clockwork units can be provided for a single casing, so that the casing can be supplied with more clockworks that the user can easily insert at his leisure.

Be it understood that the music box casing according to this invention can also be applied to supporting members which are not necessarily boxlike housings, but can be cupboard doors, carriages and many others.

The invention has been shown and described in connection with a preferred embodiment thereof, it being understood that modifications and changes can be introduced therein without departing from the scope of this invention.

I claim:

1. A music box casing assembly comprising: a mounting plate adapted to be fixed by fastening members to a vertical supporting surface; and a casing including an L-shaped base plate having a bottom wall for supporting a clock-work, music-producing mechanism and a rear wall, the rear wall and the mounting plate having complementary slidably engaged flanges and guideways such that the base plate is releasably connected to the mounting plate and may be removed therefrom by relative sliding movement, said casing further including a lid forming with the base plate a parallelepipedal box, the lid having holes therethrough for allowing passage of a starter pushbutton and a winding key of a music-producing mechanism and the lid and the base plate having complementary slidably engaged abutments and undercuts such that the lid is releasably connected to the base plate and may be removed therefrom by relative sliding movement.

2. A music box casing assembly as in claim 1 wherein the mounting plate includes two side webs and wherein the rear wall of the base plate has complementary grooves which receive said side webs.

3. A music box casing assembly as in claim 1 wherein the upper edge of the rear wall of the base plate fits within a complementary recess within the lid.

4. A music box casing assembly comprising: a mounting plate fixed by horizontal fastening members to a vertical supporting surface; and a casing including an L-shaped base plate having a horizontal bottom wall supporting a clock-work, music-producing mechanism and a vertical rear wall, the rear wall and the mounting plate having complementary vertically extending slidably engaged flanges and guideways such that the base plate is releasably connected to the mounting plate and may be removed therefrom by relative sliding movement in a vertical direction, said casing further including a lid forming with the base plate a parallelepipedal box, the lid having holes therethrough for allowing passage of a starter pushbutton and a winding key of the music-producing mechanism and the lid and the base plate having complementary slidably engaged abutments and undercuts such that the lid is releasably connected to the base plate and may be removed therefrom by relative sliding movement in a vertical direction.

* * * * *